United States Patent [19]

Fesmire et al.

[11] Patent Number: 4,479,371

[45] Date of Patent: Oct. 30, 1984

[54] WASHING AND EXTRACTING MACHINE

[75] Inventors: Robert H. Fesmire, Barrington Hills; Warren T. Hansen, Glenview, both of Ill.

[73] Assignee: Ellis Corporation, Chicago, Ill.

[21] Appl. No.: 449,142

[22] Filed: Dec. 13, 1982

[51] Int. Cl.[3] ..... D06F 23/02; D06F 37/22; D06F 37/26

[52] U.S. Cl. ..... 68/23.1; 68/24; 68/210; 51/164.1; 248/638

[58] Field of Search ..... 68/19, 23.1, 24, 140, 68/210; 248/632, 638; 34/56; 51/164.1, 163.1; 366/185, 189, 45

[56] References Cited

U.S. PATENT DOCUMENTS

| | | | |
|---|---|---|---|
| Re. 23,065 | 12/1948 | Ellis | 68/140 |
| 1,400,977 | 12/1921 | Perry | 68/210 |
| 1,611,895 | 12/1926 | Dienner | 68/140 X |
| 1,856,168 | 5/1932 | Perry | 68/210 |
| 2,115,072 | 4/1938 | Hunt et al. | 51/163.1 X |
| 2,695,103 | 11/1954 | Armstrong | 68/24 X |
| 3,197,983 | 8/1965 | Ilmer | 68/23.1 |
| 3,321,941 | 5/1967 | Ellis | 68/140 X |
| 3,359,762 | 12/1967 | Lornitzo | 68/140 X |
| 3,405,483 | 10/1968 | Boniface | 51/163.1 |
| 3,407,635 | 10/1968 | Beebe et al. | 68/210 X |
| 3,417,582 | 12/1968 | Hertig et al. | 68/210 X |
| 3,417,583 | 12/1968 | Hutterer | 68/210 |
| 3,667,707 | 6/1972 | Mui | 248/638 X |
| 3,712,090 | 1/1973 | Toth et al. | 68/210 |
| 3,896,642 | 7/1975 | Toth | 68/210 |

*Primary Examiner*—Philip R. Coe
*Assistant Examiner*—Frankie L. Stinson
*Attorney, Agent, or Firm*—Mason, Kolehmainen, Rathburn & Wyss

[57] ABSTRACT

A washing and extracting machine includes a frame assembly on which a cylindrical housing is rotatably and pivotally mounted. The housing is connected to the frame assembly by releasable connectors each including a pin secured to the housing and a toggle latch mechanism mounted on the frame and actuated by a actuator. A hydraulic motor is secured to the housing to rotate it relative to the frame. An extensible cylinder is mounted on the frame and to a bracket secured to the cylindrical housing. Upon actuation, the extensible cylinder pivots the housing relative to the frame. The bracket includes a slot in which an end of the extensible cylinder is slidably positioned. A toggle latch is mounted on the bracket to lock the end of the extensible cylinder in the slot during pivoting of the housing.

9 Claims, 14 Drawing Figures

Fig. 14
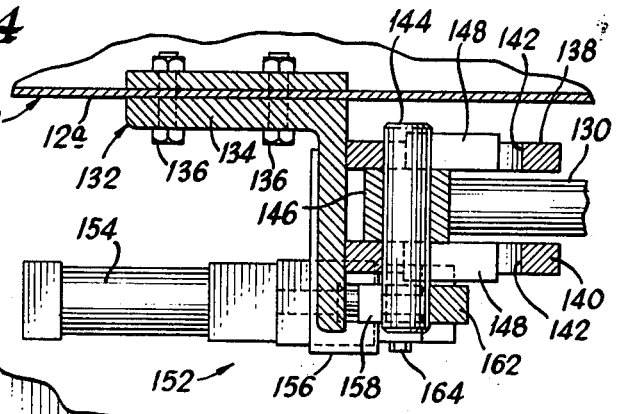
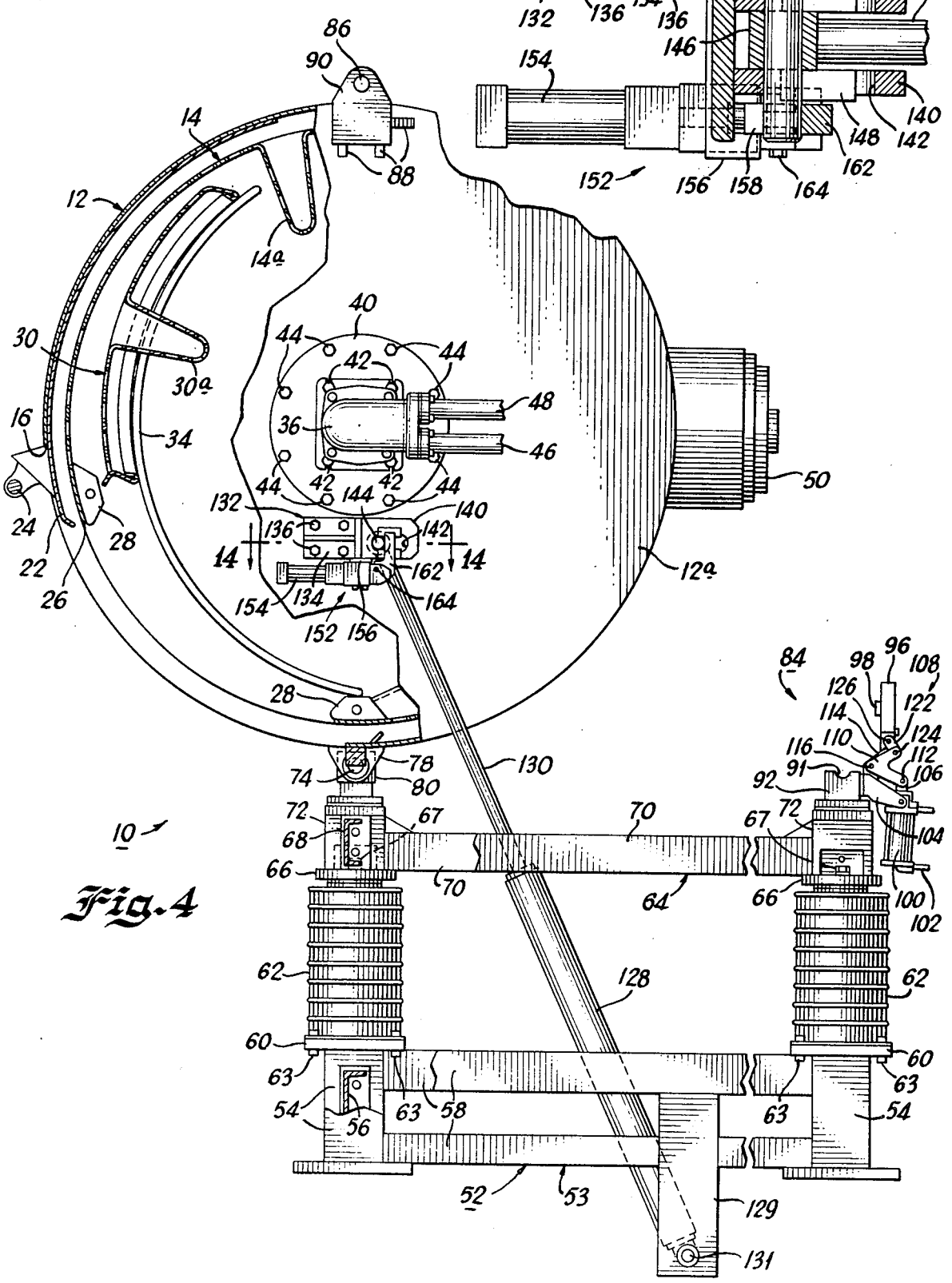
Fig. 4

Fig. 9
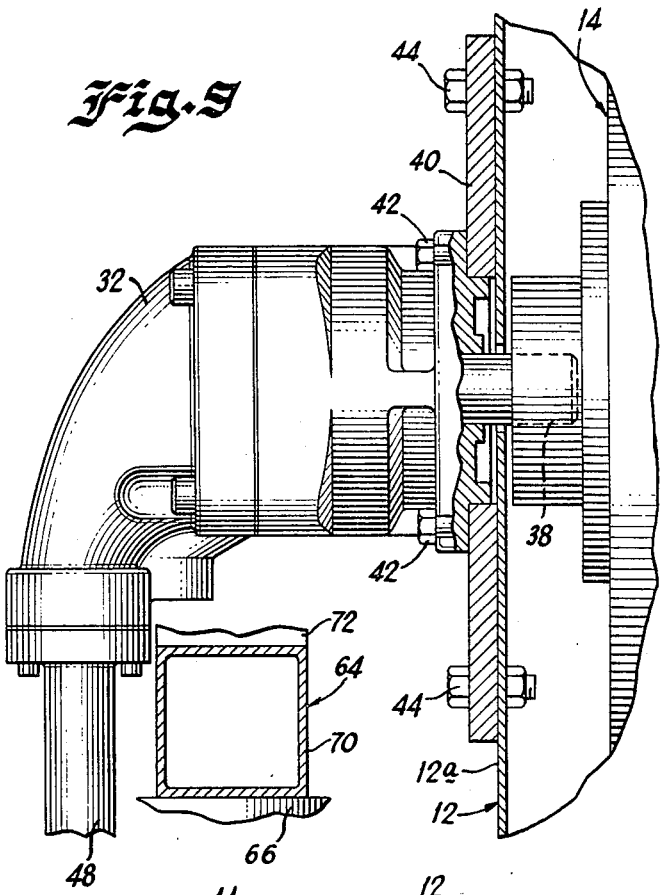
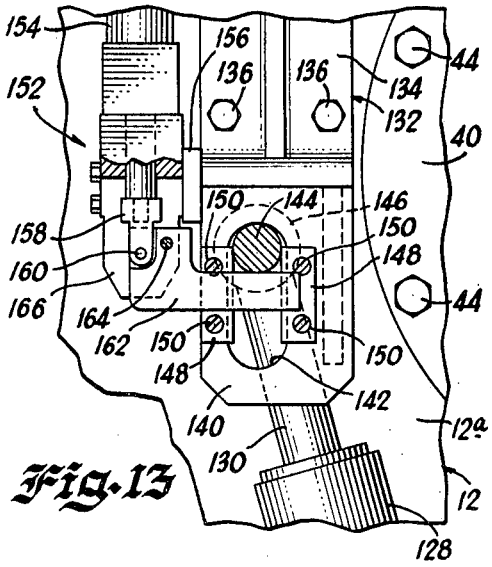
Fig. 13
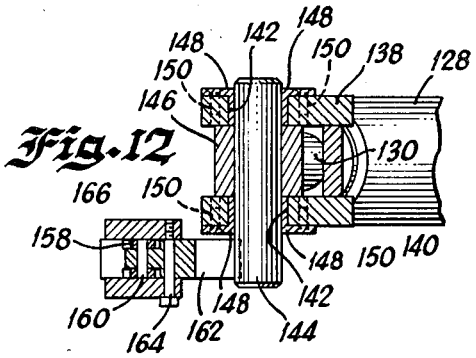
Fig. 12
Fig. 10
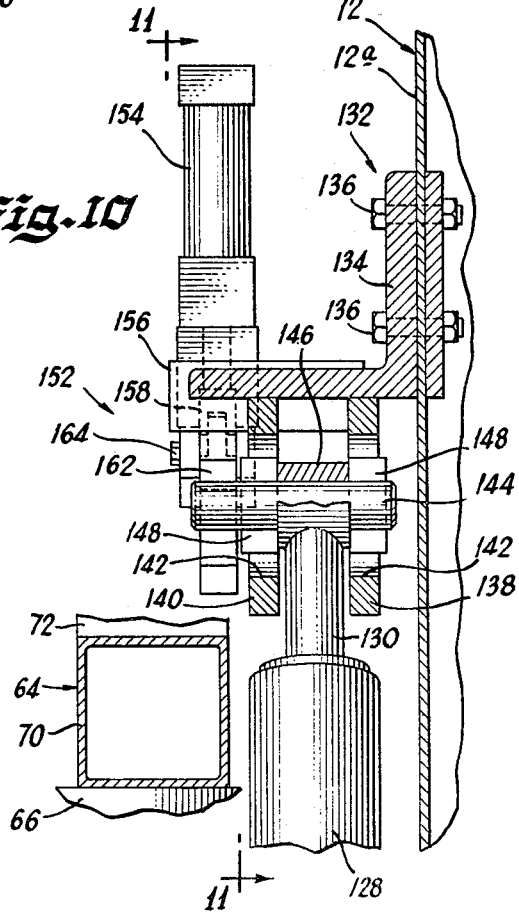
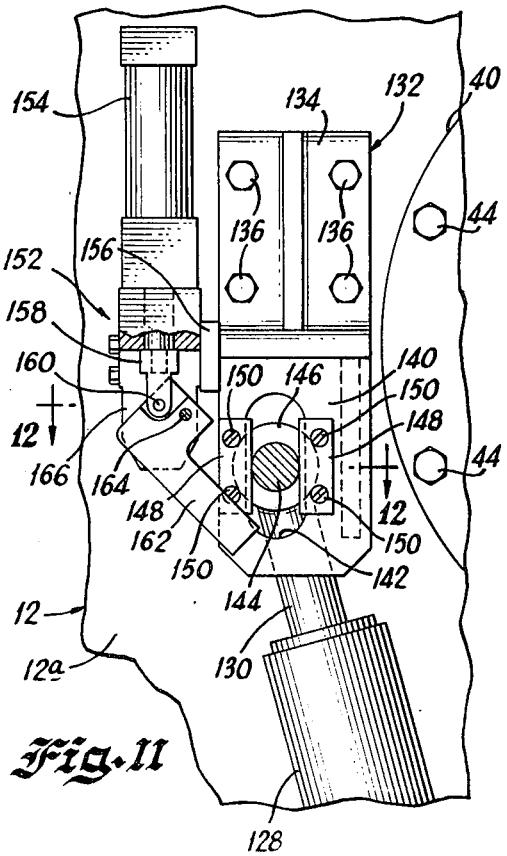
Fig. 11

WASHING AND EXTRACTING MACHINE

BACKGROUND OF THE INVENTION

A. Field of the Invention

The present invention relates to a new and improved washing and extracting machine, and more particularly to a washing and extracting machine including new and improved infinite speed motors for rotating the machine, to new and improved toggle latch mechanisms for latching the machine to a frame assembly and to a pivoting mechanism.

B. Description of the Background Art

Commercial washing and extracting machines are well suited for washing large loads of laundry material in institutions such as hospitals and hotels. One type of commercial washing machine employed for operations of this type tilts backward for loading of laundry material and forward to unload or discharge laundry material. An example of this type of machine is disclosed in U.S. Pat. No. 3,417,582. These machines are slow due to the difficulty of loading and unloading since the machines can be tilted only a limited amount and it is often necessary to load and unload at least a portion of the laundry material by hand. This procedure not only requires additional time but may be extremely dangerous since the machine often must be rotated during loading to ensure a full evenly balanced load. Water often has to be injected into these machines while loading to load all of the laundry material. Other machines are disclosed in U.S. Pat. Nos. 3,417,582 and 3,321,941.

To provide faster and more complete loading and unloading of laundry material, pivoting type washing machines have been developed. Machines of this type are illustrated in U.S. Pat. Nos. 3,712,090 and 3,896,642. A problem with pivoting machines is that they must be rigidly secured to the frame assembly during the washing cycles and must be released from the frame to allow unloading. These machines are pivoted by an extensible cylinder that includes a first end rigidly secured to the frame assembly of the machine and a second end rigidly secured to the cylinder. During operation of the machine, vibration is transmitted to the extensible cylinder through the connection of the second end creating heat and foam in the hydraulic fluid of the cylinder that could result in damage.

Most prior art machines also employ a belt or gear motor for rotating the machine during the washing and extracting cycles. Multiple speeds must be attained by the machine in the washing and extracting cycles and prior art machines employ several motors or multiple speed motors that are indirectly connected by belts or gears to the axle of the machine. Multiple motors and indirect connections are undesirable due to the increase in cost of the machine and the increased likelihood of breakdown.

SUMMARY OF THE INVENTION

An object of the present invention is to provide a new and improved commercial washing and extracting machine.

It is another object of the present invention to provide a new and improved commercial washing and extracting machine with a direct connect hydraulic motor with infinite speed capabilities.

A further object of the present invention is to provide a new and improved commercial washing and extracting machine that is connected by a toggle latch to a frame to ensure that the machine remains latched even if the control system fails.

Another object of the present invention is to provide a new and improved connection for connecting an extensible cylinder to a commercial washing and extracting machine to avoid transmission of vibration from the machine to the extensible cylinder.

The present invention is directed to a new and improved commercial washing and extracting machine for washing large loads of laundry material and extracting water from the laundry material at the completion of the washing cycle. The machine includes a frame assembly on which is pivotally mounted a cylindrical housing. The housing includes access doors for loading and unloading laundry material, and a hydraulic motor is directly coupled to the cylinder for rotating it relative to the frame. The cylinder is releasably coupled to the frame assembly by at least one connector that includes a pin secured to the cylindrical housing and a toggle latch secured to the frame. The toggle latch is actuated by an actuator from a first position latching the pin to the frame to a second position releasing the pin. The frame also includes vibration isolators for isolating vibration of the machine during operation. The cylindrical housing of the machine is connected to an extensible cylinder by a bracket that includes an elongated slot within which one end of the extensible cylinder is slidably mounted. This connection allows the machine and bracket to vibrate without transmitting vibration to the extensible cylinder. A toggle locking or latching mechanism is actuated by an actuator to latch the end of the extensible cylinder within the slot when the extensible cylinder is extended to pivot the cylindrical housing about one of the connectors.

BRIEF DESCRIPTION OF THE DRAWINGS

The above and other objects and advantages and novel features of the present invention will become apparent from the following detailed description of a preferred embodiment of the invention illustrated in the accompanying drawings, wherein:

FIG. 4 is a partially broken away end view of the machine of the present invention in the pivoted position;

FIG. 6 is a view taken generally along line 6—6 of FIG. 5;

FIG. 10 is a view taken generally along line 10—10 of FIG. 2;

FIG. 11 is a view taken generally along line 11—11 of FIG. 10;

FIG. 12 is a view taken generally along line 12—12 of FIG. 11;

FIG. 13 is a view similar to FIG. 11 with the locking arm actuated; and

FIG. 14 is a view taken generally along line 14—14 of FIG. 4.

DETAILED DESCRIPTION OF A PREFERRED EMBODIMENT

Figure 1:
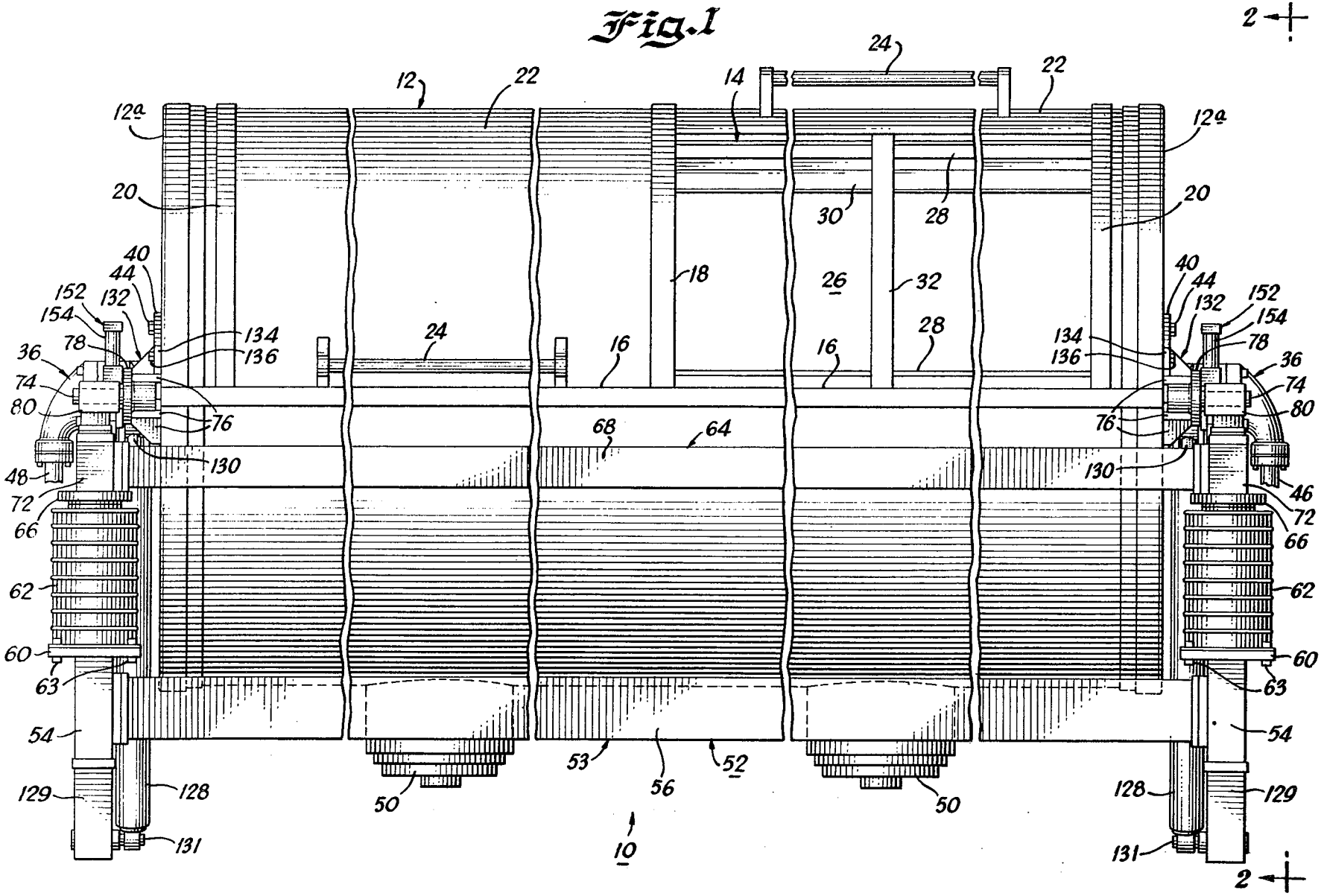
FIG. 1 is a side elevational view of a washing and extracting machine constructed in accordance with the principles of the present invention.

The present invention is a washing and extracting machine generally designated by the reference numeral 10. The machine 10 washes large loads of laundry material and at the completion of the washing cycle, extracts most of the liquid from the laundry material. As part of the operation, the machine 10 is pivoted to a position for loading and unloading of laundry material as illustrated in FIG. 4. A laundry machine that is pivoted for loading and unloading is disclosed in U.S. Pat. No. 3,896,642 assigned to the assignee of the present invention and incorporated by reference.

Figure 2:
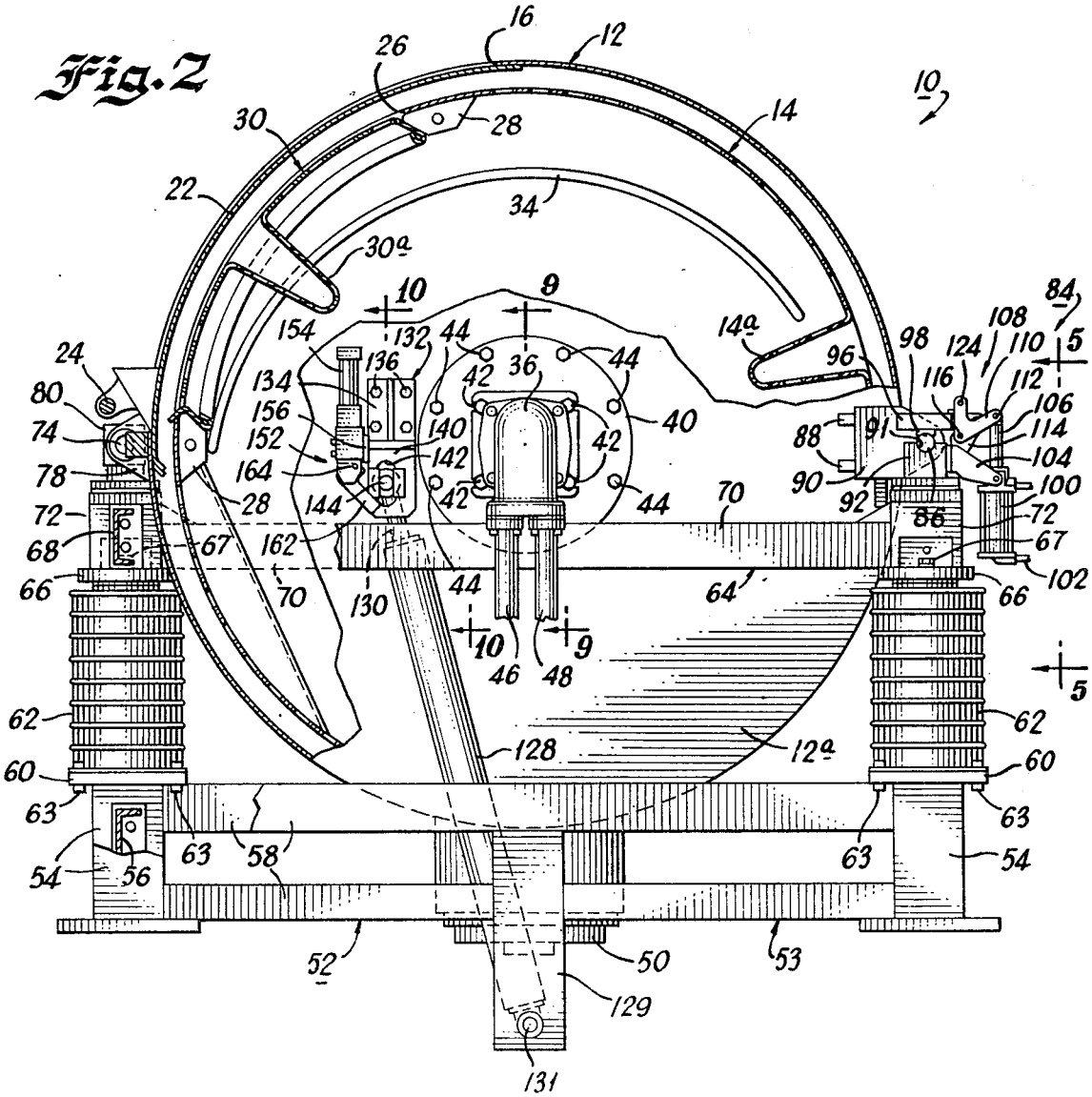
FIG. 2 is a partially broken away end view of the machine of the present invention taken generally along line 2—2 of FIG. 1.

The washing and extracting machine 10 includes a cylindrical, horizontally extending outer cylinder or housing 12 and an inner, perforated casing 14 (FIG. 2) of a slightly smaller diameter than the housing 12 and supported for coaxial rotation within the outer housing 12. The outer housing 12 includes a pair of openings 16 separated by an arcuate guide 18 allowing loading and unloading of batches of laundry material into and out of the housing 12 and casing 14. At distant ends of the openings 16 are arcuate guides 20 that are substantially the same as guide 18. Slideably mounted within the guides 20 and 18 and the openings 16 are manually actuable doors 22. Each door 22 is provided with a handle 24 that may be gripped by an operator to raise or lower the door 22. Within each opening 16 the inner casing 14 includes a pair of longitudinally spaced openings 26 bounded longitudinally on upper and lower edges by parallel rib members 28 (FIG. 2). A pair of arcuate inner casing doors 30 are provided to cover the openings 26. The doors 30 are guided by arcuate tracks 32 (FIG. 1) and 34 (FIG. 2). The inner casing 14 and the inner door 30 are provided with circumferentially spaced apart longitudinally extending and integrally formed lifts **14*a* and 30*a* for lifting and moving laundry material as the inner casing 14 rotates within the outer housing 12 during a washing cycle. The inner casing 14 is supported within the outer housing 12 for coaxial rotation by pairs of bearing structures (FIG. 9) interconnecting the circular end walls 12*a* of the housing 12 with end walls of the inner casing 14**. The bearing structures may be similar to those disclosed in U.S. Pat. No. Re. 23,065 and this patent is incorporated by reference.

During the washing and extracting cycles, the inner casing 14 is rotated at selected speeds within the outer housing 12. Substantially different speeds are required for the various washing cycles and the extracting cycle. It has been known that mechanical action during the wash cycle is important in determining the degree to which laundry material is cleaned during a wash cycle. Mechanical action is the physical influence by which the movement of the cylinder, with the corresponding lift and fall imparted to the laundry material, induces the laundry material to bend and straighten and move in relation to the water in the machine thereby loosening the soil and transferring it to the water. One of the factors determining the effectiveness of mechanical action is the wash speed and it has always been believed that this factor could not be changed. The machine 10, however, is capable of an infinite number of wash speeds as selected by the operator. To accomplish a wide range of speeds, the machine 10 includes a pair of hydraulic motors 36 each connected to a shaft 38 (FIG. 9) connected to the inner casing 14. Details of a similar driving connection are shown in the aforementioned U.S. Pat. No. Re. 23,065. Each hydraulic motor 36 is secured to a circular mounting plate 40 by fasteners 42 and the plate 40 is secured to end walls **12*a* by fasteners 44. The hydraulic motors 36 are connected to a remote hydraulic pump (not shown) through conduits 46 and 48. The operator of the machine 10 controls the speed of operation of the motors 36** by controlling the operation of the remote pump and selects a desired speed based on the size of the load, the type of material to be washed as well as other factors.

To allow dumping of water from the machine 10, dump valves 50 are provided in communication with the separate chambers within the housing 12. Valves 50 are similar in structure and function to the dump valves disclosed in the U.S. Pat. No. Re. 23,065.

The machine 10 is mounted on a frame generally designated by the reference numeral 52. Frame 52 includes a lower frame 53 defined by four corner posts 54 formed of hollow steel tubing connected adjacent the lower ends by a pair of longitudinal, horizontal support members 56 (FIG. 1). At each end of the lower frame the corner posts 54 are connected by a pair of horizontal cross members 58 (FIG. 2). At the upper end of each post 54 is an integral pad 60 to which a shock absorbing member 62 is mounted by fasteners 63. The shock absorbers 62 may be inflatable or include a plurality of springs and neoprene pads to absorb shock transmitted to the frame 52 by the machine 10 during the washing and extracting cycles. An upper frame generally designated by the reference numeral 64 is mounted on the upper ends of the shock absorbers 62 on pads 66 by fasteners 67. The upper frame 64 is rectangular including longitudinally extending side support members 68 (FIG. 1) that may be of a similar material as the members of the lower frame. At the ends of the upper frame 64 are horizontal cross members 70 (FIG. 2). The longitudinal support members 68 and the cross members 70 intersect at posts 72.

Figure 3:
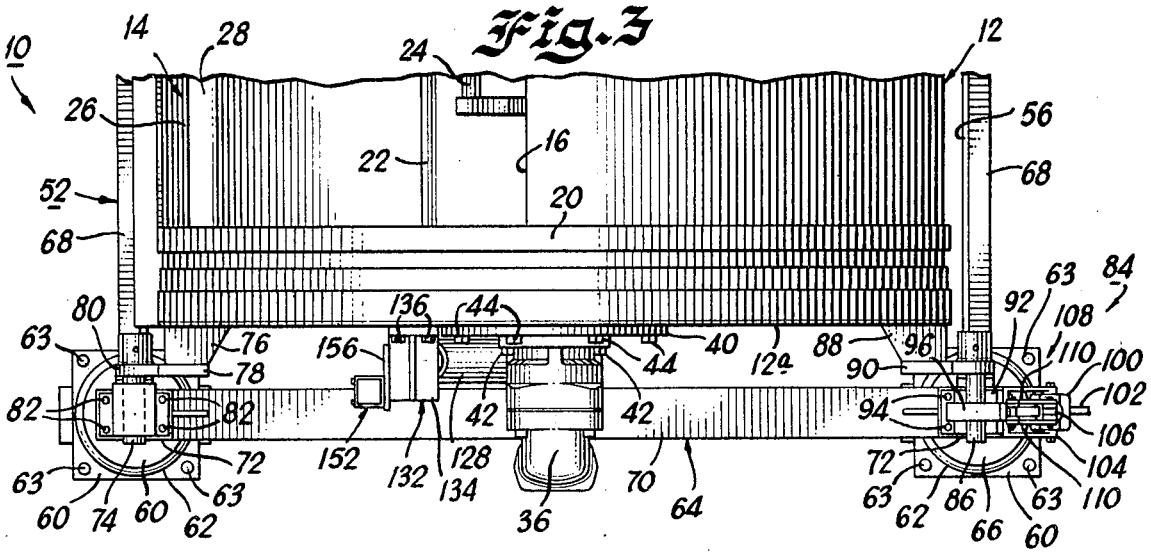
FIG. 3 is a partial, elevational plan view of FIG. 2.

The machine 10 is pivotally mounted to the frame 52 by pivot pins 74 (FIG. 2) that are rigidly mounted to the housing 12 by struts 76 and arms 78 (FIG. 3). The pins 74 are pivotally secured to the posts 72 by bearing blocks 80 that are secured to the top of posts 72 by fasteners 82. This connection allows the machine 10 to be pivoted about the front posts 72 as illustrated in FIG. 4 to allow loading and unloading of laundry material.

The machine 10 is releasably secured to the rear posts 72 by latch assemblies generally designated by the reference numeral 84. Each latch assembly 84 latches or locks a pin 86 secured to the housing 12 to the rear posts 72. Each pin 86 is secured to the housing 12 by a strut 88 and an arm 90 (FIG. 3). Assemblies 84 latch pins 86 in grooves 91 formed in holding elements 92 that are secured to the top of posts 72 by fasteners 94. During the washing and extracting cycles of machine 10, the pins 86 are held in the holding elements 92 by the assemblies 84 rigidly securing the machine 10 to the frame 52. In this position, vibration is absorbed by the shock absorbers 62.

Figures 5, 7, 8, 9:
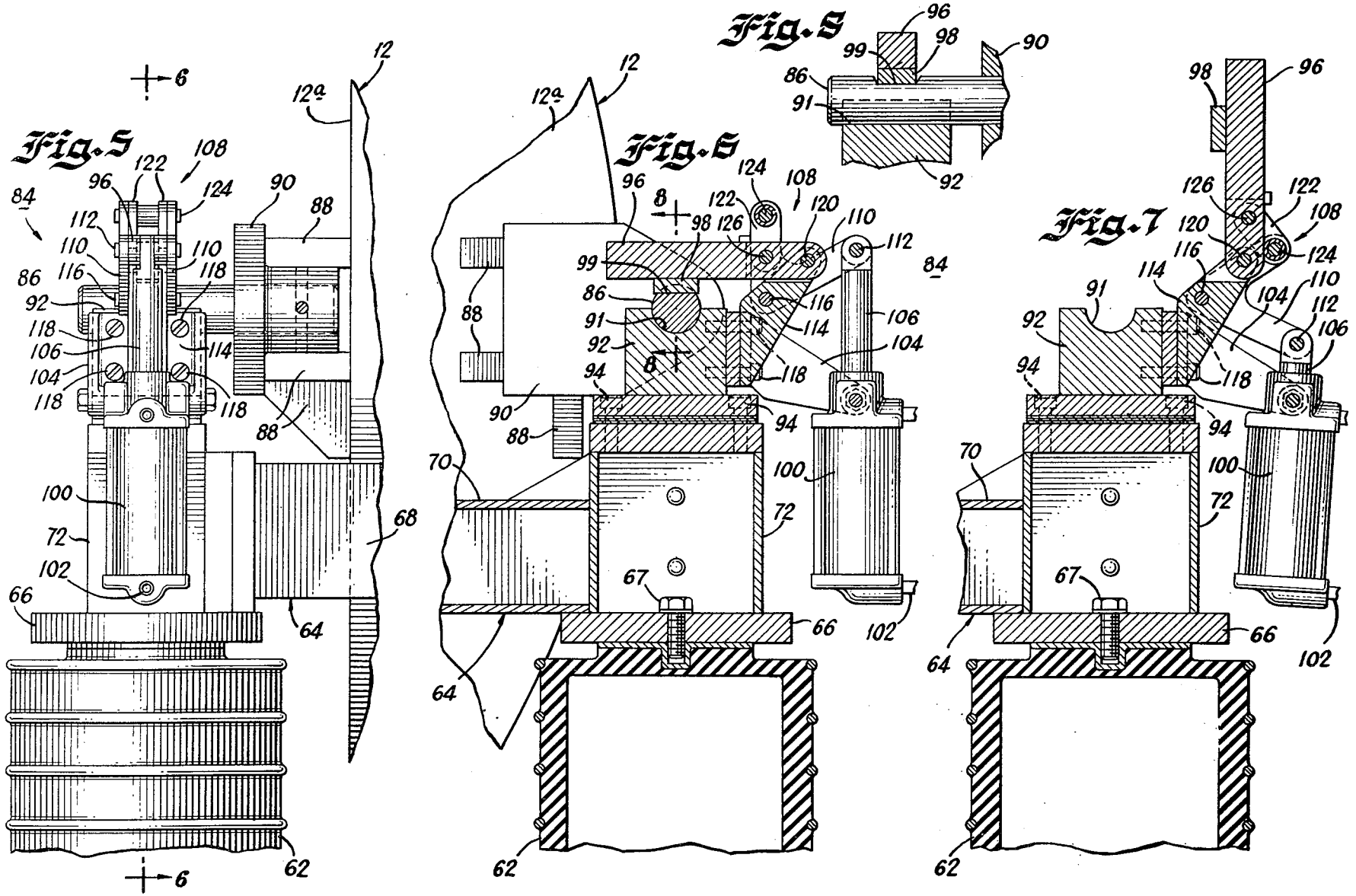
FIG. 5 is a view taken generally along line 5—5 of FIG. 2.
FIG. 7 is a view similar to FIG. 6 in the latch open position.
FIG. 8 is a view taken generally along line 8—8 of FIG. 6.
FIG. 9 is a view taken generally along line 9—9 of FIG. 2.

Assemblies 84 each includes a bar 96 including a pin engaging element 98 (FIGS. 6 and 7). Element 98 fits into a slot 99 formed in the top of the pin 86 (FIG. 8). The bar 96 holds the pin 86 in the groove 91 in the latched position.

To load or unload the machine 10, it is pivoted about the pins 74 after the pins 86 are released by lifting the bars 96 (FIG. 7). Lifting bar 96 is accomplished through actuation of a cylinder 100 that is connected by a flexible tube 102 to a remote source of fluid. Cylinder 100 is secured to the holding element 92 by a clevis 104. The cylinder 100 includes a rod 106 that is connected to a first end of an overcenter toggle mechanism 108. A second end of the toggle mechanism 108 is secured to the bar 96. As illustrated in FIGS. 5–7, the overcenter toggle mechanism 108 includes two identical sides or toggles with a first arm 110 pivotally mounted at a first end to the rod 106 by a pin 112 and to a bracket 114 by a pin 116. The bracket 114 is secured to the holding element 92 by fasteners 118. Bar 96 is pivotally mounted to bracket 114 by a pin 120. Each toggle arm 110 is also secured to a toggle lever 122 by a pin 124. Toggle lever 122 is pivotally mounted to the bar 96 by a pin 126.

In the extended position of the rod 106, the toggle or latching mechanism 108 is in the position illustrated in FIG. 6 locking bar 96 to maintain pin 86 in groove 91. If failure of the external source of fluid to the extensible cylinder 100 occurs, latch mechanism 84 will not release pin 86 since the overcenter toggle latch mechanism 108 remains in the locked position. To release the pin 86, the extensible cylinder 100 is actuated to retract the rod 106 pivoting locking arm 96 about pin 120 to a substantially vertical position (FIG. 7). Once pin 86 has been released, machine 10 may be pivoted to the position illustrated in FIG. 4 for loading or unloading of laundry material.

Machine 10 is pivoted by a pair of extensible cylinders 128 that each includes a rod 130. Each extensible cylinder 128 is pivotally mounted at a first end to a strut 129 by a pin 131. The struts 129 are rigidly secured to the cross braces 58 of the lower frame 53. Each end of rods 130 is secured to the ends **12*a* of the housing 12 by a bracket assembly generally designated by the reference numeral 132. Each bracket assembly 132, as illustrated in FIGS. 10–13, includes an angle bracket 134 rigidly secured to each end 12*a* of the housing 12 by fasteners 136. The bracket includes depending legs 138 and 140 each with a vertically elongated slot 142. A pin 144 is positioned within slot 142 and mounted in a sleeve 146 that is rigidly secured to the end of rod 130. To ensure proper positioning of the pin 144 in the slot 142, pin engagement members 148 are secured to the legs 138 and 140 adjacent slot 142 by screws 150**.

During operation of machine 10, it is desirable that vibration from rotation of the housing 12 is not imparted to the extensible cylinder 128. Vibration could damage the cylinder 128 by overheating and foaming of the hydraulic fluid. During operation of machine 10, pin 144 is allowed to move within the slot 142 and vibration of the machine 10 is not imparted to rod 130. If machine 10 is to be pivoted to the position illustrated in FIG. 4, however, the pin 144 is firmly locked within the slot 142 to prevent movement of the machine 10 relative to the rod 130. To latch pin 144 in the slot 142, latching assemblies 152 are employed (FIGS. 10–13). Latching assemblies 152 include extensible cylinders 154 mounted to the brackets 134 by bars 156. Each extensible cylinder 154 includes a rod 158 pivotally connected by a pin 160 to a locking or latching arm 162. The latching arm 162 is pivotally mounted by a pin 164 to plates 166 that are secured to or integral with the latching assembly 152. If the machine 10 is to be pivoted, the rods 158 are extended and each latching arm 162 is pivoted to the position illustrated in FIG. 13 to engage pins 144 holding them against the upper end of the slots 142. During operation of the machine 10, in the washing and extracting cycles, the latching arms 162 are pivoted to the position illustrated in FIG. 11 by retracting rods 158 allowing the rods 144 to move within the slot 142.

Machine 10 as disclosed pivots about the pins 74; however, it is to be understood that latching assemblies identical to assemblies 84 may be included to latch the pins 74 to allow bidirectional pivoting in a manner similar to that illustrated in U.S. Pat. No. 3,896,642 incorporated by reference herein.

What is claimed is:

1. A washing and extracting machine capable of being pivoted to load and unload laundry material, comprising:

a frame, a cylinder rotatably mounted on said frame, means for rotating said cylinder relative to said frame at a plurality of speeds including a variable first speed for washing said laundry material and a variable second speed for extracting liquid from said laundry material, means for allowing said cylinder to pivot on said frame to load and unload said laundry material, means for pivoting said cylinder relative to said frame, said pivoting means including an extensible member secured to said frame at a first end and to said cylinder at a second end, said second end slidably mounted in a slot fabricated in a bracket secured to said cylinder to allow limited movement of said second end relative to said cylinder, and means for locking said second end in said slot, said locking means including a latching lever movable from a first position out of engagement with said second end to a second position engaging and locking said second end in said slot, and means for actuating said latching lever from said first and second positions.

2. The washing and extracting machine claimed in claim 1 wherein said means for allowing said cylinder to pivot includes a latching pin on said cylinder, a holding element secured to said frame for holding said latching pin, an over-center toggle secured to said frame actuable to a first position locking said latching pin in said holding element and to a second position releasing said latching pin from said holding element, and means for actuating said toggle from said first and second positions.

3. The washing and extracting machine claimed in claim 1 further comprising means on said frame for isolating vibration during operation of said machine including a resilient body.

4. The washing and extracting machine claimed in claim 1 wherein said rotating means comprises a hydraulic motor connected to said cylinder along a longitudinal axis thereof.

5. A combination washing and extracting machine, comprising:

a frame, a housing rotatably mounted on said frame, said housing including at least one door to allow placement of laundry material into and removal of laundry material from said housing, means for releasably securing said housing to said frame, said securing means includes a pin on said housing, a holder for said pin secured to said frame, a latch movable to a first position to latch said pin in said holder and to a second position spaced from said pin and said holder, said latch including a toggle mechanism, an actuator secured to said toggle mechanism for moving said latch between said first and second positions, means for rotating said housing, and means for pivoting said housing relative to said frame, said pivoting means including a bracket secured to said housing, said bracket including an elongated slot, an extensible cylinder secured at a first end to said frame and a second end slidably positioned in said slot, means for latching said second end in said slot to prevent sliding movement therein including an actuator secured to said frame and a lever pivotally coupled to said actuator, said lever actuable by said actuator to a first position engaging and latching said second end in said slot and to a second position releasing said second end.

6. The combination washing and extracting machine set forth in claim 5 further comprising at least one vibration isolation assembly mounted on said frame including at least one inflatable member.

7. A combination laundry washing and extracting machine pivotable to load and unload laundry material, comprising:

a frame assembly;

a housing rotatably mounted on said frame along a longitudinal axis, said housing including a door assembly allowing access into said housing, means secured to said housing for rotating said housing around said longitudinal axis, at least one connection assembly for releasably connecting said housing to said frame assembly, said connection assembly including a latching pin secured to said housing, a holder for said pin mounted on said frame assembly, a toggle latch actuable from a first position latching said latching pin in said holder to a second position releasing said latching pin, and an actuator secured to said frame assembly and connected to said toggle latch for actuating said toggle latch from said first and second positions, means for pivoting said housing including a bracket with an elongated slot secured to said housing, an extensible cylinder with a first end secured to said frame assembly and a second end slidably positioned in said slot, a locking assembly for locking said second end in said slot, said locking assembly including an actuator mounted on said frame assembly, a lever secured to said actuator to engage said second end in a first position and to be spaced from said second end in a second position, and a vibration isolation assembly secured to said frame assembly including at least one resilient member.

8. The combination washing and extracting machine set forth in claim 7 wherein said rotating means includes a hydraulic motor secured to said housing at said longitudinal axis.

9. The combination washing and extracting machine set forth in claim 7 wherein said bracket is spaced from said longitudinal axis of said housing.

* * * * *